US007971774B2

(12) United States Patent
Yaloz et al.

(10) Patent No.: US 7,971,774 B2
(45) Date of Patent: Jul. 5, 2011

(54) DRINKING APPARATUS

(76) Inventors: Ofir Yaloz, Ramat-Gan (IL); Ilan Shaya, Haifa (IL); Idan Azulay, Haifa (IL)

( * ) Notice: Subject to any disclaimer, the term of this patent is extended or adjusted under 35 U.S.C. 154(b) by 73 days.

(21) Appl. No.: 12/467,817

(22) Filed: May 18, 2009

(65) Prior Publication Data

US 2010/0288826 A1 Nov. 18, 2010

(51) Int. Cl.
*B65D 3/28* (2006.01)

(52) U.S. Cl. ..... 229/401; 229/402

(58) Field of Classification Search ..... 229/401, 229/402; 206/217, 831; 220/735
See application file for complete search history.

(56) References Cited

U.S. PATENT DOCUMENTS

| | | | | | |
|---|---|---|---|---|---|
| 2,745,586 | A | * | 5/1956 | Thoma | 229/401 |
| 2,840,292 | A | * | 6/1958 | Stoddard | 229/401 |
| 2,867,365 | A | | 1/1959 | La Tourette, Jr. | |
| 3,357,623 | A | | 12/1967 | Wommelsdorf | |
| 3,458,107 | A | | 7/1969 | Lane et al. | |
| 3,828,999 | A | * | 8/1974 | Humphrey | 229/401 |
| 4,171,085 | A | | 10/1979 | Doty | |
| 4,393,988 | A | * | 7/1983 | Burke | 229/401 |
| 5,007,578 | A | * | 4/1991 | Simone | 206/831 |
| 5,996,887 | A | | 12/1999 | Cai et al. | |
| D443,475 | S | * | 6/2001 | Miura | D7/507 |
| D443,477 | S | * | 6/2001 | Miura | D7/507 |
| D444,672 | S | * | 7/2001 | Miura | D7/507 |
| 7,753,224 | B2 | * | 7/2010 | Cai | 220/715 |
| 2009/0114708 | A1 | * | 5/2009 | Sung et al. | 229/120 |

FOREIGN PATENT DOCUMENTS

| | | |
|---|---|---|
| CN | 2885043 | 4/2007 |
| DE | 20305673 | 8/2003 |
| KR | 20050099584 | 10/2005 |

* cited by examiner

*Primary Examiner* — Gary E Elkins
(74) *Attorney, Agent, or Firm* — The Law Office of Michael E. Kondoudis

(57) ABSTRACT

A drinking apparatus comprising a base and a sheet having a first end and a second end. The sheet is rolled to exhibit an inner side and a predefined perimeter, such that the first end is adhesively attached to the inner side of the rolled sheet, and such that the second end protrudes outwardly from the predefined perimeter of the rolled sheet. The rolled sheet is adhesively attached to the base to form an impervious cup. The second end comprises an operationally separable spoon-like stirrer, the spoon-like stirrer comprising an elongated end and a broadened end. Separating the operationally separable spoon-like stirrer leaves a hollow in the second end. The hollow is arranged to operationally serve as a handle to the impervious cup.

2 Claims, 5 Drawing Sheets

DRINKING APPARATUS

BACKGROUND

1. Technical Field

The present invention relates to the field of drinking appliances, and more particularly, to a cup incorporating a spoon-like stirrer.

2. Discussion of Related Art

Handy and practical appliances allowing users to drink their beverages on the go are desired.

The following documents are incorporated herein by reference in their entirety: U.S. Pat. No. 2,745,586, which discloses a paper cup with a stirring spoon-like stirrer made unitary therewith; U.S. Pat. No. 2,867,365, which discloses a container; U.S. Pat. No. 3,357,623, which discloses a paper cup; U.S. Pat. No. 3,458,107, which discloses a cup-and-spoon-like stirrer assembly; U.S. Pat. No. 4,171,085, which discloses a tear tab disposable cup or container structure; and U.S. Pat. No. 5,996,887 Cup with separable coupon; as well as Korean Patent Document No. KR20050099584, which discloses an instant detachable spoon-like stirrer attached to paper cup; Chinese Patent Document No. CN2885043, which discloses a cup attached with spoon-like stirrer; and German Patent Document No. DE20305673, which discloses a cup, with handle and spoon-like stirrer, has spoon-like stirrer stick extending through upper and lower holes in handle.

BRIEF SUMMARY

Embodiments of the present invention provide a drinking apparatus comprising a base and a sheet having a first end and a second end. The sheet is rolled to exhibit an inner side and a predefined perimeter, such that the first end is adhesively attached to the inner side of the rolled sheet, and such that the second end protrudes outwardly from the predefined perimeter of the rolled sheet. The rolled sheet is adhesively attached to the base to form an impervious cup. The second end comprises an operationally separable spoon-like stirrer, the spoon-like stirrer may be spoon-like and longitudinally foldable. Separating the operationally separable spoon-like stirrer leaves a hollow in the second end. The hollow is arranged to operationally serve as a handle to the impervious cup.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

The present invention will be more readily understood from the detailed description of embodiments thereof made in conjunction with the accompanying drawings of which.

DETAILED DESCRIPTION

Figure 1:
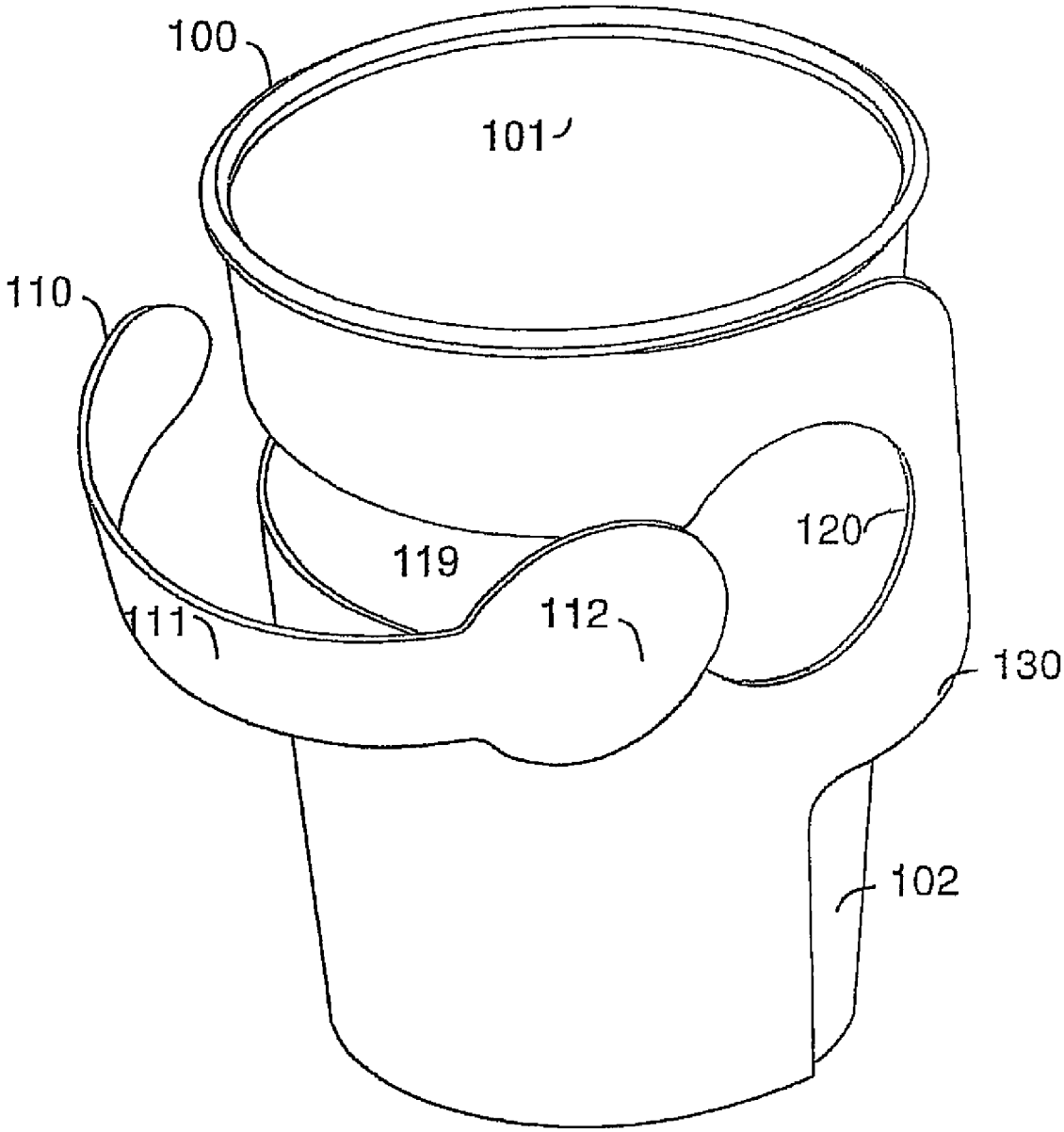
FIG. 1 is a schematic illustration of a drinking apparatus according to some embodiments of the invention.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 is a schematic illustration of a drinking apparatus according to some embodiments of the invention. The drinking apparatus comprises an impervious cup 100 that may be constructed by rolling a sheet 130 and connecting rolled sheet 130 to a base (not shown in FIG. 1), e.g. adhesively, such that an inner side 101 and a predefined perimeter 102 are exhibited. The drinking apparatus further comprises a separable spoon-like stirrer 110, comprising an elongated end 111 and a broadened end 112, that is connected to the second end of sheet 130 and in impervious cup 100 protrudes outwardly from perimeter 102 of the rolled sheet 130 (the first end, not shown in FIG. 1, being the one adhesively attached to the inner side of rolled sheet 130). Spoon-like stirrer 110 may be spoon-like and/or longitudinally foldable.

In operation, separable spoon-like stirrer 110 may be separated from the protruding second end of sheet 130 in impervious cup 100. Separating separable spoon-like stirrer 110 leaves a hollow 119 in the second end, which may serve as a handle 120 to impervious cup 100.

Figure 2:
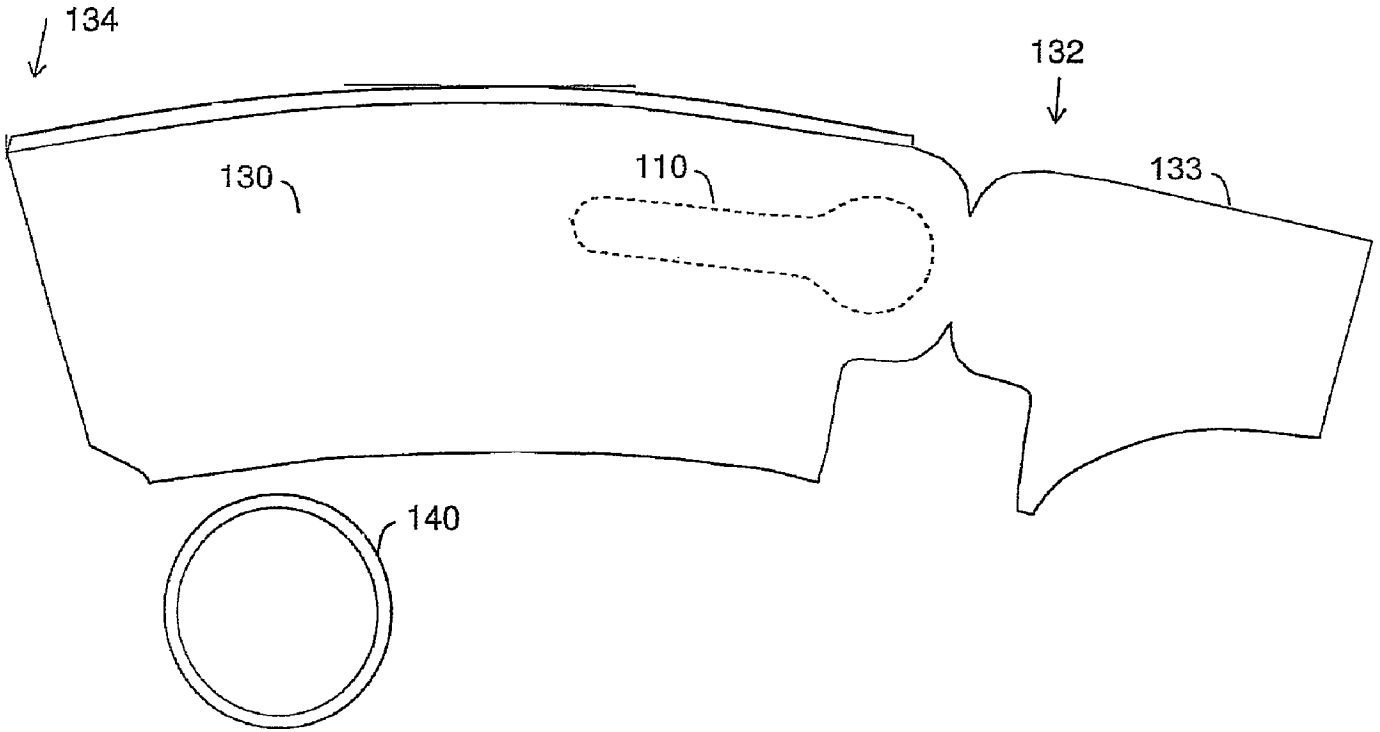
FIG. 2 is a schematic illustration of a base and a sheet for constructing a drinking apparatus, according to some embodiments of the invention.

FIG. 2 is a schematic illustration of a base 140 and a sheet 130 for constructing a drinking apparatus, according to some embodiments of the invention. Thin lines denote folding lines, while the broken line denotes a cut out line. Sheet 130 comprises a first end 134 and a second end 132. Sheet 130 may be rolled to form an impervious cup, such that first end 134 is adhesively attached to the inner side of the rolled sheet 130 and such that second end 132 protrudes outwardly from the predefined perimeter of the rolled sheet 130. Base 140 may be adhesively attached to rolled sheet 130 to form the impervious cup. Second end 132 comprises a separable spoon-like stirrer 110. After rolling sheet 130, second end 132 with separable spoon-like stirrer 110 protrudes outwardly from the predefined perimeter of the impervious cup, and separating spoon-like stirrer 110 simultaneously allows a user of the impervious cup to utilize spoon-like stirrer 110 and grasp the impervious cup utilizing the hollow left at second end 132 by separating spoon-like stirrer 110 as a handle. Second end 132 comprises an extension 133 that may be folded back and attached to the impervious cup to form a convenient handle.

Figure 3A:
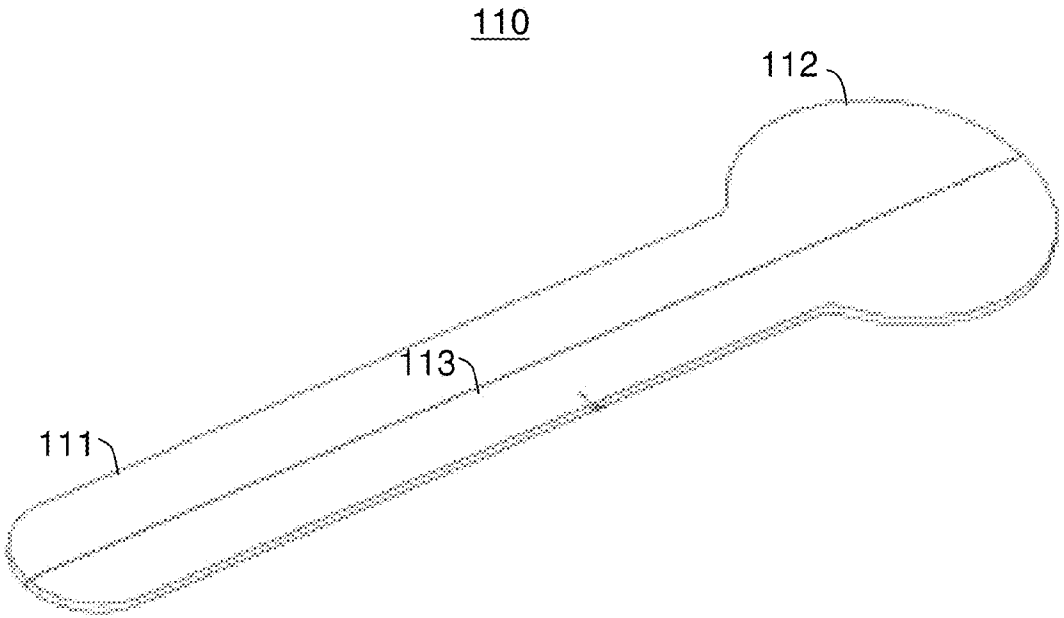
FIGS. 3A and 3B are schematic illustrations of a spoon-like stirrer, according to some embodiments of the invention.
Figure 3B:
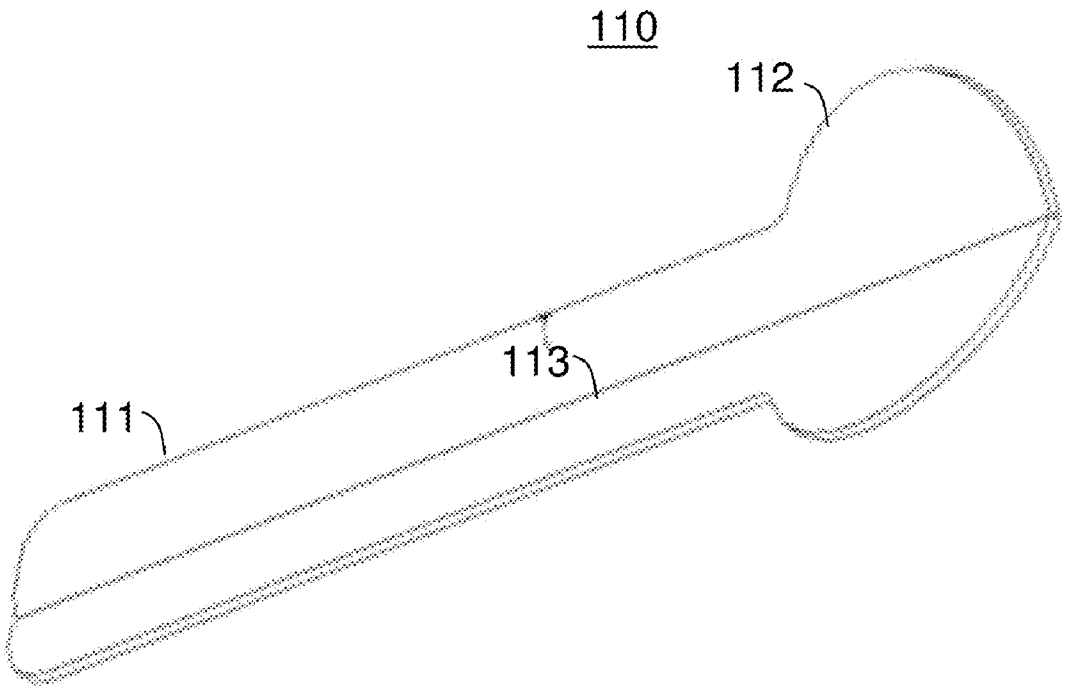

FIGS. 3A and 3B are schematic illustrations of a spoon-like stirrer 110, according to some embodiments of the invention. Spoon-like stirrer 110 comprises an elongated end 111 and a broadened end 112. Spoon-like stirrer 110 may be spoon-like and/or longitudinally foldable (FIG. 3B). Spoon-like stirrer 110 may be separable from an impervious cup, and may be folded (FIG. 3B) along its long axis 113 to enhance its operability, especially after being separated from the impervious cup. Folding spoon-like stirrer 110 along its long axis 113 may lend spoon-like stirrer 110 additional strength and balance possible structural impediments resulting from its being previously attached to the impervious cup.

Figure 4:
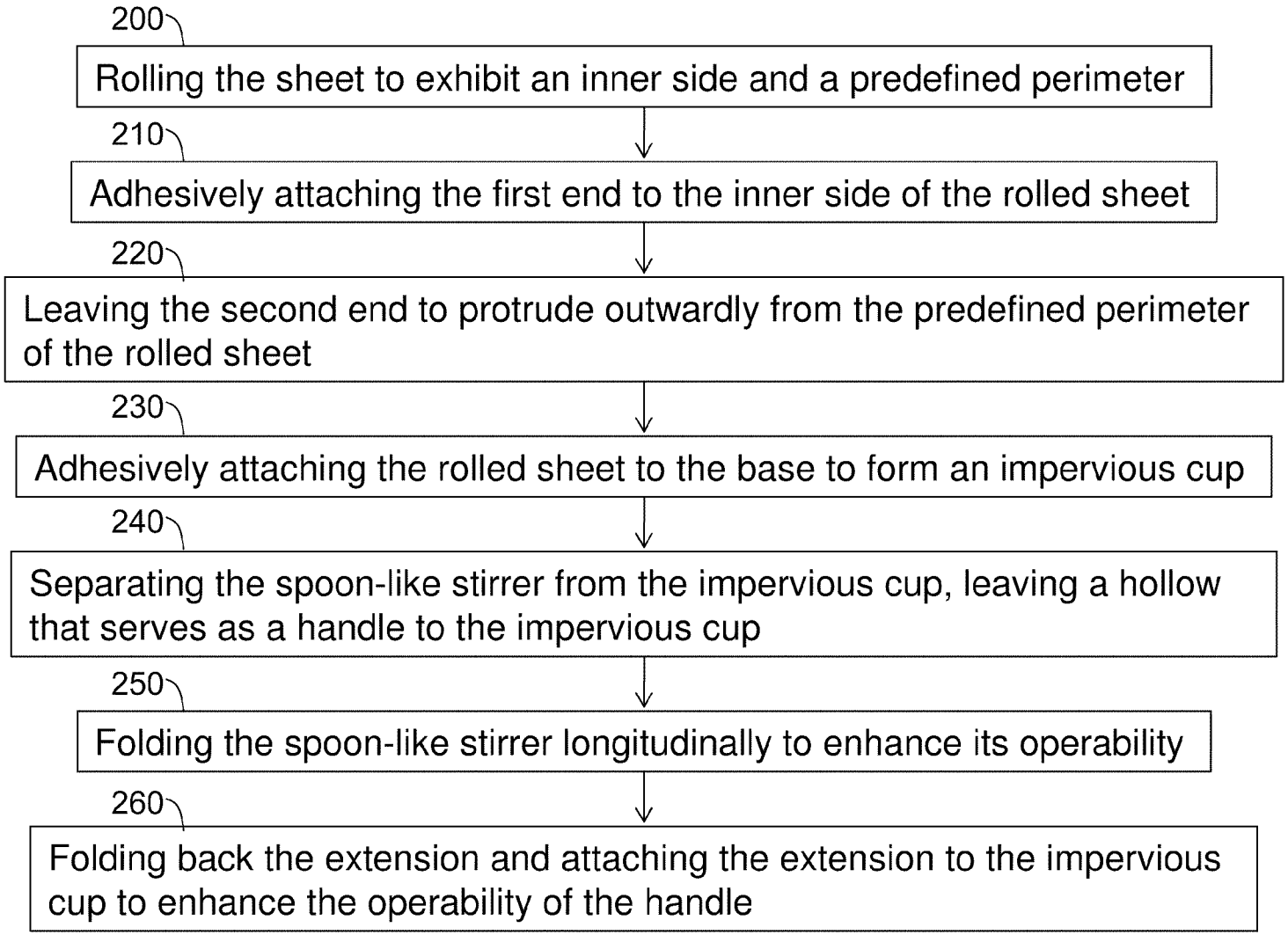
FIG. 4 is a high level flowchart illustrating a method of producing a drinking apparatus according to some embodiments of the invention.

FIG. 4 is a high level flowchart illustrating a method of producing a drinking apparatus according to some embodiments of the invention. The drinking apparatus comprises an impervious cup with a handle and a spoon-like stirrer. The method produces the drinking apparatus from a base and a sheet having a first end and a second end. The second end comprises an operationally separable spoon-like stirrer comprising an elongated end and a broadened end. The method comprises the stages: rolling the sheet to exhibit an inner side and a predefined perimeter (stage 200); adhesively attaching the first end to the inner side of the rolled sheet (stage 210); leaving the second end to protrude outwardly from the predefined perimeter of the rolled sheet (stage 220); adhesively attaching the rolled sheet to the base to form an impervious cup (stage 230); and separating the operationally separable spoon-like stirrer from the impervious cup, leaving a hollow in the second end, operationally serving as a handle to the impervious cup (stage 240).

According to some embodiments of the invention, the method further comprises folding the spoon-like stirrer longitudinally to enhance its operability (stage 250). The folding line may optionally be straight According to some embodiments of the invention, the second end may further comprise an extension, and the method may further comprise folding back the extension and attaching the extension to the impervious cup to enhance the operability of the handle (stage 260).

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. A drinking apparatus comprising:

a base; and a sheet having a first end and a second end, wherein the sheet is rolled to exhibit an inner side and a predefined perimeter, such that the first end is adhesively attached to the inner side of the rolled sheet, and such that the second end protrudes outwardly from the predefined perimeter of the rolled sheet, and wherein the rolled sheet is adhesively attached to the base to form an impervious cup;

wherein the second end comprises a separable spoon-like stirrer, the spoon-like stirrer comprising an elongated end and a broadened end, wherein separating the separable spoon-like stirrer leaves a hollow in the second end, the hollow is arranged to operationally serve as a handle to the impervious cup, wherein the spoon-like stirrer is longitudinally foldable when separated from the second end, and wherein the second end further comprises an extension that is folded back and attached to the impervious cup to enhance the operability of the handle.

2. A method of producing a drinking apparatus comprising an impervious cup with a handle and a spoon-like stirrer from a base and a sheet having a first end and a second end, the second end having an operationally separable spoon-like stirrer, the spoon-like stirrer having an elongated end and a broadened end, the method comprising:

rolling the sheet to exhibit an inner side and a predefined perimeter;

adhesively attaching the first end to the inner side of the rolled sheet;

leaving the second end to protrude outwardly from the predefined perimeter of the rolled sheet;

adhesively attaching the rolled sheet to the base to form an impervious cup;

separating the operationally separable spoon-like stirrer from the impervious cup, leaving a hollow in the second end, operationally serving as a handle to the impervious cup; and folding the spoon-like stirrer longitudinally to enhance its operability, wherein the second end further comprises an extension, and the method further comprising folding back the extension and attaching the extension to the impervious cup to enhance the operability of the handle.

* * * * *